United States Patent [19]

Wadsworth

[11] 4,426,739

[45] Jan. 24, 1984

[54] BAITING SLEEVES FOR ICE FISHING

[76] Inventor: Gary J. Wadsworth, 779 Wallace St., Wallaceburg, Ontario,, Canada, N8A 1L3

[21] Appl. No.: 312,296

[22] Filed: Oct. 16, 1981

[51] Int. Cl.[3] ..... A41D 13/08

[52] U.S. Cl. ..... 2/16

[58] Field of Search ..... 2/16

[56] References Cited

U.S. PATENT DOCUMENTS

| | | | |
|---|---|---|---|
| 1,194,627 | 8/1916 | Hill | 2/59 |
| 1,302,038 | 4/1919 | Hayes | 2/59 |
| 1,508,834 | 9/1924 | Cohen | 2/59 |
| 2,326,422 | 10/1943 | Weisberger | 2/59 |
| 3,657,741 | 4/1972 | Blanco | 2/59 |

FOREIGN PATENT DOCUMENTS

| | | | |
|---|---|---|---|
| 287546 | 5/1928 | United Kingdom | 2/59 |

*Primary Examiner*—Doris L. Troutman

*Attorney, Agent, or Firm*—Richard L. Miller

[57] ABSTRACT

A pair of sleeve extenders for ice fishermen; each of which includes a length of transparent, flexible plastic material, having an elastic tape sewn around one end edge of the tubing.

1 Claim, 4 Drawing Figures

BAITING SLEEVES FOR ICE FISHING

This invention relates generally to equipment for use in ice fishing. More specifically it relates to extensions for garment sleeves.

BACKGROUND OF THE INVENTION

It is well known by anyone who has ever done any ice fishing that it is a big problem in trying to keep the hands and fingers warm while the fisherman is out on the ice where the cold wind is free from obstructions so to blow hard. In such weather, it becomes particularly difficult to bait a hook without ones fingers becoming numbed by the cold air.

SUMMARY OF THE INVENTION

Accordingly it is a principal object of the present invention to provide a pair of sleeve extenders which are attachable to to the sleeves of a worn garment such as a coat, the sleeves protecting the hands and finger from the cold wind.

Yet another object is to provide sleeves for ice fishing which are made transparent so as to allow the fisherman to see therethrough and watch the fingers while baiting a fish hook inside an environment that is free of blowing cold wind.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures on the drawings are briefly described as follows.

DETAILED DESCRIPTION OF THE PREFERRED EMBODIMENT

Figures 1, 2, 3, 4:
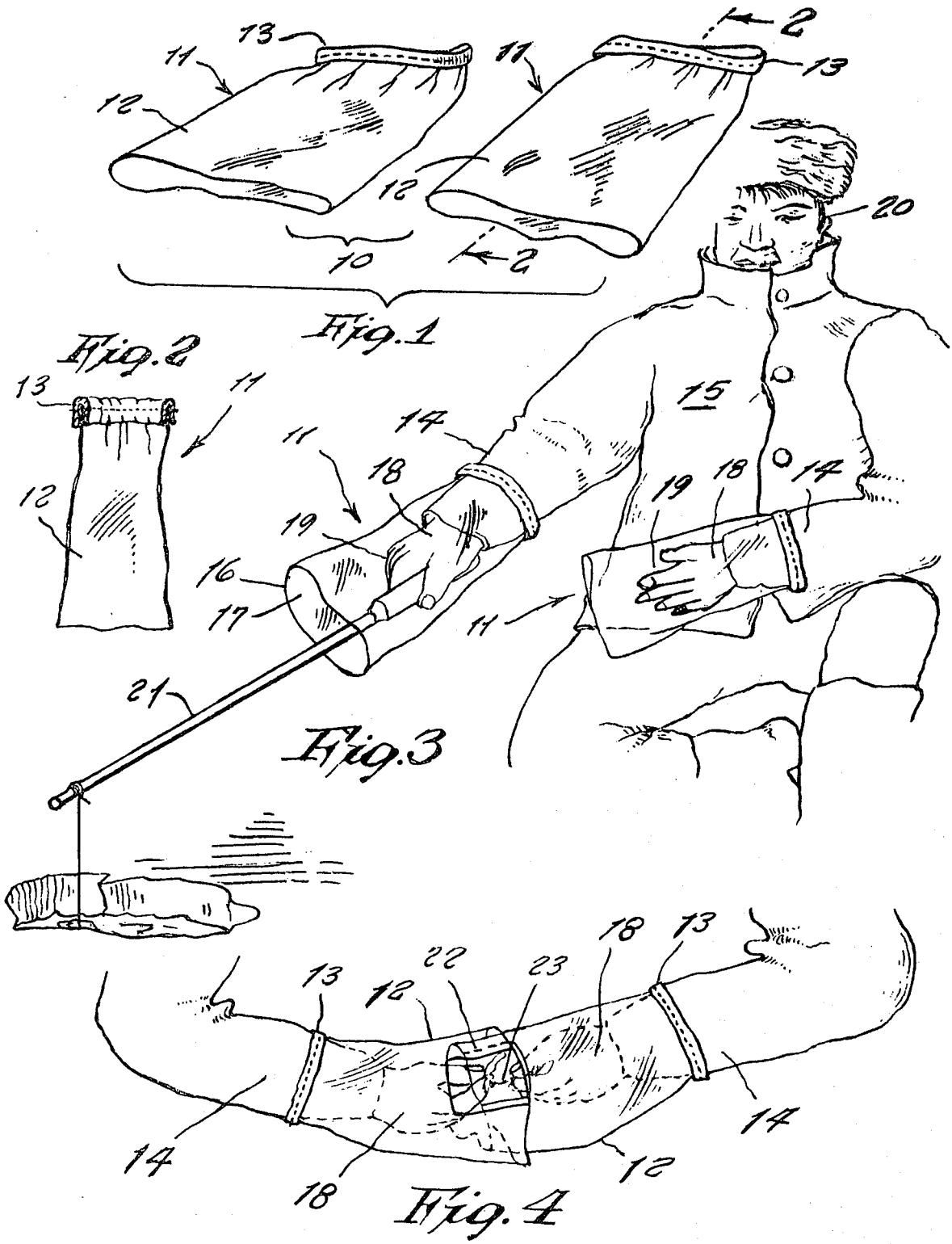
FIG. 1 is a perspective view of the invention.
FIG. 2 is a cross sectional view on line 2—2 of FIG. 1.
FIG. 3 shows the sleeves in use to shield the hands from the wind while fishing on the ice.
FIG. 4 shows the sleeves in use as a provective enclosure while bating a hook.

Referring now to the drawing in greater detail, the reference numeral 10 represents a pair of Baiting Sleeves For Ice Fishing, according to the present invention, wherein each sleeve 11 is comprises of a length of flexible tubing 12 made from a transparent plastic material. An elastic tape 13 is sewn around one end edge of the tubing, so that this end of the tubing may gather for being removably attached around an outer side of a sleeve or sleeve cuff 14 of a coat 15. The opposite end edge 16 of the tubing is left in a plain condition around an opening 17 as shown. The length of the sleeve is such so that it can fully enclose the hand 18 and fingers 19 of the fisherman 20.

In a non-operative use, the sleeve may be simply either removed from the sleeve cuff or else its free end may be turned or rolled up over the upper portion of the coat sleeve.

In operative use, as shown in FIG. 3, the tubing is turned down so as to enclose the hand and fingers, and a fishing rod 21, held in the hand 18, may protrude out of the tubing opening 17 during the fishing operation. The flexiblity of the tubing permits the same for use as a soft mitten for grasping various objects. The inexpensive tubing is waterproof so as to keep fingers dry when handling wet objects. Accordingly in a modified construction, such tubing may be made fleeced on its inner side for warmth, the fleece material being left off a small area of the tubing, in the vicinity of the fingers so that this portion of the tubing remains transparent in the form of an observation window.

In further operative use, as shown in FIG. 4, the open ends of both sleeves 11 can be fitted together so as to form a completely wind proof enclosure 22 within which the fingers of both hands can work together for baiting a hook 23 in comfort, the transparent tubings allowing the fisherman to see the progress of the baiting operation inside the enclosure.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. A pair of baiting sleeves for ice fishing, having an observation window comprising: in combination, two separate sleeve extenders, each one of which is comprised of a length of tubing made from a transparent flexible plastic material; means at one end of said tubing for removable securement around a sleeve or sleeve cuff of a coat while said tubing extends therefrom and fully encloses lengthwise a user's hand extending outwardly of said sleeve or said sleeve cuff; said means comprising an elastic tape sewn around an end edge of said edge of said tubing; and an inner side of said tubing being made with a fleece material for purpose of warmth, said fleece material being left off a small area of said tubing in a vicinity of the fingers of the user's hand so that said area forms an observation window, whereby the user may observe his fingers during a baiting procedure while still having the comfort of insulating his hands from the cold exterior environment.

* * * * *